US009778004B2

(12) United States Patent
Rumfitt et al.

(10) Patent No.: US 9,778,004 B2
(45) Date of Patent: Oct. 3, 2017

(54) SMOKE PAYLOAD APPARATUS

(71) Applicant: BAE SYSTEMS plc, London (GB)

(72) Inventors: Michael Shaun Rumfitt, Monmouthshire (GB); Andy Oden Burn, Monmouthshire (GB); David Anthony Holley, Monmouthshire (GB); David John Costin, Monmouthshire (GB)

(73) Assignee: BAE SYSTEMS plc, London (GB)

( * ) Notice: Subject to any disclaimer, the term of this patent is extended or adjusted under 35 U.S.C. 154(b) by 0 days.

(21) Appl. No.: 14/913,041

(22) PCT Filed: Aug. 18, 2014

(86) PCT No.: PCT/GB2014/052529
§ 371 (c)(1),
(2) Date: Feb. 19, 2016

(87) PCT Pub. No.: WO2015/025144
PCT Pub. Date: Feb. 26, 2015

(65) Prior Publication Data

US 2016/0202031 A1 Jul. 14, 2016

(30) Foreign Application Priority Data

Aug. 20, 2013 (EP) ..... 13275189
Aug. 20, 2013 (GB) ..... 1314867.1

(51) Int. Cl.
*F42B 12/58* (2006.01)
*F42B 12/48* (2006.01)
*F42B 12/64* (2006.01)

(52) U.S. Cl.
CPC ..... *F42B 12/48* (2013.01); *F42B 12/64* (2013.01)

(58) Field of Classification Search
USPC ..... 102/334, 342, 343, 499
See application file for complete search history.

(56) References Cited

U.S. PATENT DOCUMENTS 2,421,859 A 6/1947 Whitney
2,943,572 A 7/1960 Flett
(Continued)

FOREIGN PATENT DOCUMENTS

DE 1913790 A1 10/1970
DE 3206497 A1 11/1982
(Continued)

OTHER PUBLICATIONS

International Search Report and Written Opinion received for Patent Application No. PCT/GB2014/052529, mailed on Sep. 17, 2014. 11 pages.

(Continued)

*Primary Examiner* — J. Woodrow Eldred
(74) *Attorney, Agent, or Firm* — Finch & Maloney PLLC

(57) ABSTRACT

The invention relates to a smoke payload apparatus, particularly a smoke payload ejection apparatus housed within a common carrier payload delivery shell, with a frangible safety link.

There is provided a smoke screen munition comprising a shearable tail unit, a main body which comprises a payload cavity for receiving a smoke payload apparatus, a fuze, an ogive element located between said main body and the fuze, and an explosive train operably connected to said fuze, wherein the smoke payload apparatus comprises a plurality of unconfined portions of a smoke generating energetic material, wherein said portions burn on at least two surfaces.

20 Claims, 2 Drawing Sheets

(56) References Cited

U.S. PATENT DOCUMENTS

| | | | | |
|---|---|---|---|---|
| 3,055,300 | A | 9/1962 | Stoeher | |
| 3,677,182 | A | 7/1972 | Peterson | |
| 3,750,575 | A | 8/1973 | Heede et al. | |
| 3,834,312 | A | 9/1974 | Simmons | |
| 3,842,741 | A | 10/1974 | Brothers et al. | |
| 3,981,244 | A | 9/1976 | Adimari et al. | |
| 4,226,185 | A | 10/1980 | Tobler et al. | |
| 4,557,198 | A | 12/1985 | Hickey | |
| 4,651,648 | A | 3/1987 | Alon | |
| 4,771,696 | A | 9/1988 | Smolnik | |
| 4,793,260 | A | 12/1988 | Kruse et al. | |
| 4,807,533 | A | 2/1989 | von Entress-Fursteneck | |
| 4,833,993 | A | 5/1989 | Garcia-Garcia | |
| 4,860,659 | A | 8/1989 | Andreetta | |
| H000959 | H | 9/1991 | Heckman et al. | |
| 5,107,768 | A | 4/1992 | Langenohl | |
| 5,210,372 | A | 5/1993 | Tripptrap et al. | |
| 5,233,127 | A | 8/1993 | Sauvestre et al. | |
| 5,317,975 | A * | 6/1994 | Sauvestre | F42B 12/62 102/357 |
| 5,347,931 | A | 9/1994 | Day | |
| 5,386,781 | A | 2/1995 | Day | |
| 5,454,324 | A | 10/1995 | Larmignat et al. | |
| 5,684,267 | A | 11/1997 | Dean | |
| 5,792,981 | A | 8/1998 | Singer et al. | |
| 6,523,478 | B1 * | 2/2003 | Gonzalez | F42B 30/04 102/216 |
| 6,679,177 | B1 | 1/2004 | Wu et al. | |
| 6,782,829 | B1 | 8/2004 | Han et al. | |
| 6,860,185 | B2 | 3/2005 | Altenau | |
| 6,981,450 | B1 | 1/2006 | Adimari | |
| 7,121,210 | B2 | 10/2006 | Steele | |
| 7,124,690 | B1 | 10/2006 | Tadros et al. | |
| 7,360,489 | B1 | 4/2008 | Han et al. | |
| 8,601,950 | B2 | 12/2013 | Dau et al. | |
| 2002/0166475 | A1 * | 11/2002 | Brooks | F42B 12/60 102/489 |
| 2003/0116051 | A1 | 6/2003 | Kravel et al. | |
| 2003/0205161 | A1 | 11/2003 | Roach | |
| 2004/0107860 | A1 | 6/2004 | Loubser | |
| 2004/0134372 | A1 | 7/2004 | Scherer et al. | |
| 2005/0066842 | A1 | 3/2005 | Brunn et al. | |
| 2005/0223930 | A1 | 10/2005 | Bootes et al. | |
| 2007/0006767 | A1 | 1/2007 | Brislin et al. | |
| 2009/0151590 | A1 | 6/2009 | Dau et al. | |
| 2011/0079164 | A1 | 4/2011 | Broden et al. | |
| 2012/0044710 | A1 | 2/2012 | Jones | |
| 2012/0180686 | A1 | 7/2012 | Jones et al. | |
| 2013/0055917 | A1 | 3/2013 | Menefee, III | |
| 2013/0186295 | A1 | 7/2013 | Kravel | |
| 2013/0239838 | A1 | 9/2013 | Kravel | |
| 2013/0319278 | A1 | 12/2013 | Kravel | |
| 2014/0013985 | A1 | 1/2014 | Kravel | |
| 2016/0202031 | A1 | 7/2016 | Rumfitt et al. | |
| 2016/0209189 | A1 * | 7/2016 | Adams | F42B 12/42 |
| 2016/0209190 | A1 | 7/2016 | Jones | |
| 2016/0209191 | A1 | 7/2016 | Adams et al. | |

FOREIGN PATENT DOCUMENTS

| | | | |
|---|---|---|---|
| DE | 3339039 | A1 | 5/1985 |
| DE | 102007048074 | A1 | 4/2009 |
| EP | 0466499 | A1 | 1/1992 |
| FR | 1398715 | A | 5/1965 |
| FR | 2697328 | A1 | 4/1994 |
| FR | 2699659 | A1 | 6/1994 |
| GB | 143281 | | 5/1920 |
| GB | 1179804 | A | 2/1970 |
| GB | 1415274 | | 11/1975 |
| GB | 2105813 | A | 3/1983 |
| GB | 2274905 | A | 8/1994 |
| JP | 2011047527 | A | 3/2011 |
| WO | 2015025141 | A1 | 2/2015 |
| WO | 2015025143 | A1 | 2/2015 |
| WO | 2015025144 | A1 | 2/2015 |
| WO | 2015025145 | A1 | 2/2015 |

OTHER PUBLICATIONS

GB Intellectual Property Office Search Report under Section 17(5) received for GB Patent Application No. 1314867.1 mailed Dec. 20, 2013. 4 pages.

Extended European Search Report received for EP Patent Application No. 13275189.2 mailed Feb. 7, 2014. 6 pages.

International Preliminary Report on Patentability received for Patent Application No. PCT/GB2014/052529, mailed on Mar. 3, 2016. 7 pages.

International Search Report and Written Opinion received for Patent Application No. PCT/GB2014/052528, mailed on Sep. 17, 2014. 11 pages.

GB Intellectual Property Office Search Report under Section 17(5) received for GB Patent Application No. 1314868.9 mailed Dec. 20, 2013. 4 pages.

Extended European Search Report received for EP Patent Application No. 13275190.0 mailed Jan. 31, 2014. 7 pages.

International Search Report and Written Opinion received for Patent Application No. PCT/GB2014/052530, mailed on Sep. 17, 2014. 11 pages.

GB Intellectual Property Office Search Report under Section 17(5) received for GB Patent Application No. 1314865.5 mailed Dec. 20, 2013. 4 pages.

Extended European Search Report received for EP Patent Application No. 13275187.6 mailed Jan. 29, 2014. 5 pages.

International Search Report and Written Opinion received for Patent Application No. PCT/GB2014/052526, mailed on Sep. 17, 2014. 11 pages.

GB Intellectual Property Office Search Report under Section 17(5) received for GB Patent Application No. 1314869.7 mailed Dec. 13, 2013. 6 pages.

Extended European Search Report received for EP Patent Application No. 13275188.4 mailed Feb. 4, 2014. 7 pages.

GB Intellectual Property Office Search Report under Section 17(6) received for GB Patent Application No. 1314869.7 (as it relates to claim 14) mailed Jun. 13, 2014. 3 pages.

International Preliminary Report on Patentability received for Patent Application No. PCT/GB2014/052530, mailed on Mar. 3, 2016. 7 pages.

International Preliminary Report on Patentability received for Patent Application No. PCT/GB2014/052526, mailed on Mar. 3, 2016. 7 pages.

International Preliminary Report on Patentability received for Patent Application No. PCT/GB2014/052528, mailed on Mar. 3, 2016. 7 pages.

* cited by examiner

SMOKE PAYLOAD APPARATUS

The invention relates to a smoke payload apparatus, particularly a smoke payload ejection apparatus housed within a common carrier payload delivery shell, with a frangible safety link.

There is a requirement to provide munitions that are Insensitive Munition (IM) compliant such that they undergo a low order event in response to a hazard event. There is also a desire that in the event of a blind, such as where a munition lands without functioning, that the munition fails in a safe mode.

Launched smoke munitions, such as smoke shells, typically comprise a plurality of smoke canisters which are metal canisters filled with a smoke producing agent, such as red phosphorous or hexachloroethane. The smoke munitions typically burn in a cigarette fashion, from one surface only. Whilst there may be a plurality typically 155 shells contain 4 such canisters.

According to a first aspect of the invention there is provided a smoke screening munition comprising a shearable tail unit, a main body which comprises a payload cavity for receiving a smoke payload apparatus, a fuze, an ogive element located between said main body and the fuze, and an explosive train operably connected to said fuze, wherein the smoke payload apparatus comprises a plurality of unconfined portions of a smoke generating energetic material, wherein said portions burn on at least two surfaces.

The portions preferably are ignited such that they burn on all of their exposed surfaces. It has been found that a plurality of unconfined portions, at least 10, preferably in the range of 20 to 40, unconfined portions may be dispersed over a wider area, and as all surfaces of the unconfined portions burn at substantially the same time, the effectiveness of the smoke screen is realised more quickly and efficiently. Clearly, with a significant increase in the number of portions capable of providing smoke, any portion which fails to ignite, has less of an impact on the overall screening effect. The smoke canister deployed in the prior art are made from smoke generating pyrotechnics which are confined in a metal container, which restricts the burn to only one surface of the pyrotechnic, namely a cigarette burn. Unconfined pellets are able to be ignited and sustain a burning reaction on all of their outer surfaces.

The smoke payload apparatus is tethered to the shearable tail unit; this ensures that upon ejection the tail unit remains attached to the payload apparatus, limiting the number of finite discarded components thus reducing the risk of collateral damage.

The tethered payload apparatus and the tail unit have a combined mass which is comparable to that of the mass of the empty payload delivery shell body. This results in the empty shell and smoke payload apparatus with tethered tail unit possessing comparable ballistic properties; as a result they will tend to share a common ballistic impact point, further reducing the risk of collateral damage. The empty payload delivery shell and smoke payload apparatus with tail unit may progress beyond the delivery point of the unconfined portions of smoke generating energetic material.

In a preferred arrangement the main body comprises a first threaded portion manufactured from a first material, and the tail unit comprises a second threaded portion manufactured from second material, wherein the second material has a lower hardness value than the first material; more preferably the first material is selected from a steel alloy and the second material is selected from aluminium or alloy thereof. The tail unit including the thread may be made from aluminium such that when the expulsion charge is initiated it causes the tail unit thread to fail and shear.

The unconfined portions of a smoke generating energetic material may be any smoke generating composition, preferably smoke compositions comprising red phosphorous or hexachloroethane. The red phosphorous composition is preferably in a consolidated form, not a loose powder, to ensure a reproducible, steady burn rate and survivability in a gun launch environment. The red phosphorous composition may be in the form of consolidated i.e. pressed pellets of powdered composition or extruded polymers, or any commonly used form of a red phosphorus smoke composition. The portions are unconfined, such that at least two, preferably all surfaces are available to support a burning front. This allows for rapid smoke generation, in a controlled manner.

The smoke payload apparatus may comprise a support shaft, with at least one vertical support and at least one horizontal support to accommodate said unconfined portions of a smoke generating energetic material, particularly unconfined consolidated pellets of a smoke composition.

The unconfined portions of the smoke generating energetic material abut at least two separate vertical supports, and there is a gap between the between said portions and the support shaft, to provide a flash path or through-hole extending the length of the smoke payload apparatus, such that the exothermic output from the expulsion charge may extend the length of the smoke payload apparatus and ignite all of the unconfined portions of the smoke generating energetic materials, preferably at substantially the same time.

Munitions, particularly gun launched munitions experience large forces upon launch, the provision of horizontal supports and vertical supports reduces the loads experienced on the smoke composition pellets, such that the plurality of pellets are stacked and separated by said vertical and horizontal supports. In a preferred arrangement the stacked pellets are separated from each other with a barrier, such as for example, polymers, foams, paper etc. Particularly preferred barrier materials are low friction paper, gas absorbent foams, the latter providing a means of absorbing any undesirable gaseous products that evolve from the red phosphorous composition during long term storage, such as phosphine gas.

According to a further aspect of the invention there is provided a method of dispensing a smoke payload apparatus from a munition as defined hereinbefore, comprising the steps of causing initiation of the expulsion charge, which causes ignition of said portions of smoke generating energetic materials and shearing of the shearable thread, such that said smoke payload apparatus which is tethered to said shearable tail unit is caused to be pushed rearwardly from said shell, to disperse said portions of smoke generating energetic materials.

In a further arrangement the smoke screening munition is a frangible munition comprising a tail unit, a main body which comprises a payload cavity for receiving a smoke payload apparatus, a fuze, and an explosive train operably connected to said fuze, located between said main body and the fuze, is a frangible ogive element, wherein the frangible ogive element and main body are retained in operable engagement by at least one frangible link, such that upon an impact, said frangible link is caused to fail; such that in the event of a blind and upon impact with the ground, said frangible link fails so as to allow venting of any pressure from any energetic events.

The frangible link may be any connection means, connector or fixing, which operably links the frangible ogive element to the main body, such that the munition is able to function in the intended designed mode, but which is severable or shearable upon application of a substantial force.

The frangible link may, such as, for example be a further shearable thread or at least one shear pin which retains said main body and frangible ogive element in an operable engagement.

The further shearable thread allows the frangible ogive element to be reversibly operably engaged with the main body. The frangible ogive element and main body may comprise cooperatively engaging male and female threaded portions, wherein at least one of the threads is a shearable thread. The use of a shearable thread allows the frangible ogive element to be readily fitted and removed without damaging the shearable linkage.

The main body threaded portion may be manufactured from a first material, and the ogive threaded portion may be manufactured from second material, wherein the second material has a lower hardness value than the first material, such that upon an applied force, such as, for example impact with the ground after a blind, the lower hardness material readily undergoes plastic deformation such that the frangible ogive element disengages from the main body.

In a highly preferred arrangement the first material is selected from a steel alloy and the second material is selected from aluminium or alloy thereof. For gun launched munitions, such as, for example shells, the forces experienced during launch will place the shell under uniform compression, however impact with the ground, typically at an incident angle will place the frangible ogive element and main body under a tensile load or shearing load, forcing said frangible link to fail, hence allowing venting of any gaseous outputs, the failure of the link may substantially damage the frangible link or even detachment of the frangible ogive element from the main body. The extent of the failure is such that if the explosive train or expulsion charge where to function that the output may be unconfined i.e. vented, and reduce the severity of the event. The extent of any energetic material event may be reduced such that there is a reduced pressure build up and may not cause the primary payload to be ejected from the shell, or may not cause the primary payload to function.

The smoke payload apparatus and payload cavity are selected such that they are preferably of a uniform dimension, such that any payload may be readily inserted into the uniform payload cavity of the munition. In a preferred arrangement the payload is a modular unit. This allows flexibility on logistics, that any payload may be inserted into any available carrier munition or shell. Conventional smoke and illumination payloads have bespoke shells or munitions and there is no interchangeability between munitions.

The smoke payload apparatus may be inserted into the payload cavity from the aft end of the munition. The smoke payload apparatus may be slidably engaged with the payload cavity, such as for example it may have an engineering fit with payload cavity, such that the smoke payload apparatus may be prevented from moving within a direction which is normal to the elongate, i.e. longitudinal axis of the munition. The payload cavity may have substantially parallel walls, which extend from the intersection of main body and tail unit up to the locking ring. To prevent movement of the smoke payload apparatus within the cavity along the longitudinal axis of the munition, a locking ring may be located between the main body and said frangible ogive element, to retain said smoke payload apparatus within the payload cavity and prevent movement. Preferably the locking ring and main body comprise cooperatively engaging threaded portions, to allow reversible locking engagement. This allows the locking ring to compensate for any tolerances in manufacture of the smoke payload apparatus, to ensure that the smoke payload apparatus is retained in position.

The shearable thread on the tail unit allows the smoke payload apparatus to be reversibly loaded from the aft of the main body. Prior art shells secure the tail unit to the main body with shearable pins, which irreversibly fasten the tail unit to the main body, such that once the munition is constructed the tail unit may only be removed by function of the munition or by applying substantial force, to cause shearing of the pins. The use of a shearable thread allows the tail unit to be readily fitted via facile low cost manufacturing methods, compared to when employing the use of shearable pins.

In a preferred arrangement the smoke payload apparatus is reversibly loadable from the aft end of the main body. The provision of a threaded tail unit allows the smoke payload apparatus to be loaded and removed from the aft end. In a highly preferred arrangement during use the payload is capable of being dispensed rearwardly from the main body, upon shearing the shearable thread.

The frangible ogive element is a portion of the munition, typically a shell body, and may be reversibly operably engaged with the fuze and main body. Preferably the tail unit, main body frangible ogive element and are secured together by shearable threads and further shearable threads, respectively.

The frangible ogive element may have a forward end locatable with said fuze and an aft end locatable with said main body, wherein the internal diameter of the aft end of said frangible ogive element may be substantially the same as the internal diameter of said payload cavity. The position of the ogive portion and overall length of the ogive portion has been set so that the main body of shell is elongate compared to non-modular shells and therefore can afford to have a long internal dimension of one diameter.

The fuze may be any known fuze, such as those that respond to selected input or stimuli or a combination of inputs, such as, for example, mechanical actions of the projectile, such as the action of high g forces from gun launch or high spin rates from imparted spin, timed delay, either mechanical or pyrotechnic, caused by separation from the launch system, or proximity to a target. The energetic output of the fuze may be carefully balanced with the expulsion charge, to ensure consistent, reliable and suitable ignition of the expulsion charge. The fuze may function due to electronic activation, such as, for example, from an input from a sensor or detector from on-board said munition or external to the munition. On-board systems may be internal guidance systems. External stimuli may be provided by, remote control, GPS or target activated laser guidance etc.

The fuze may be operably connected to an explosive train, to provide an energetic output, such as an expulsion charge Where the payload is delivered during flight i.e. rather than a terminal effect, the payload may be expelled from the munition by an expulsion charge. In preferred arrangement said expulsion charge is suspended in free space, such that it does not physically contact the smoke payload apparatus; this allows for manufacturing tolerances between the expulsion charge and the smoke payload apparatus. The fuze device will comprise safety and arming units (SAU), energetic trains to provide sufficient stimuli to the expulsion charge.

Where both the, main body and tail unit and the frangible ogive element and main body are fastened with shearable threaded portions and further shearable threaded portions, respectively, the shearable threaded portion has a lower shear strength than the further shearable thread, such that during the intended use of the munition that the shearable thread between the tail unit and main body fails first, so as to permit the expulsion of the charge from the aft of the main body.

According to a further aspect of the invention there is provided a method of dispensing a payload from a munition as defined herein, comprising the steps of causing initiation of the expulsion charge, causing shearing of the shearable thread.

Whilst the invention has been described above, it extends to any inventive combination of the features set out above, or in the following description, drawings or claims.

Exemplary embodiments of the device in accordance with the invention will now be described with reference to the accompanying drawings in which:—

Figure 3A:
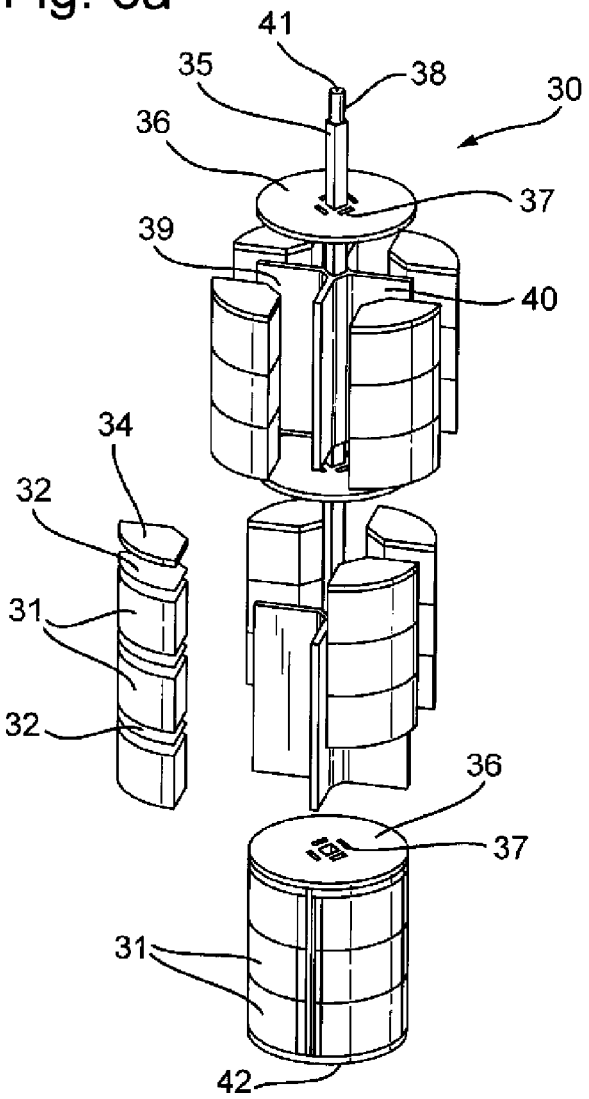
Figure 3B:
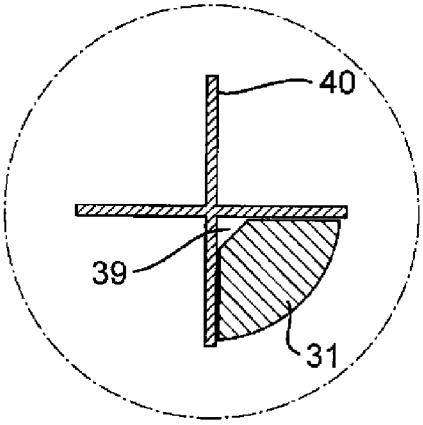

FIGS. 3*a* and 3*b* show a smoke payload apparatus

Figure 4:
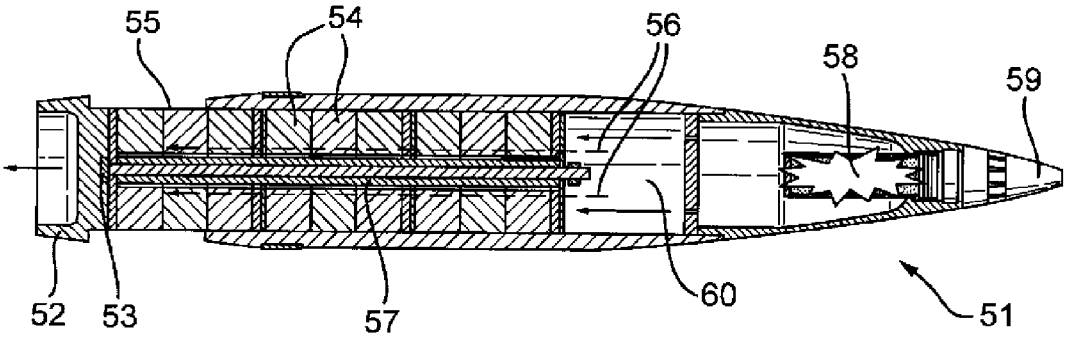

FIG. 4 shows a partially ejected smoke payload apparatus.

Figure 1:
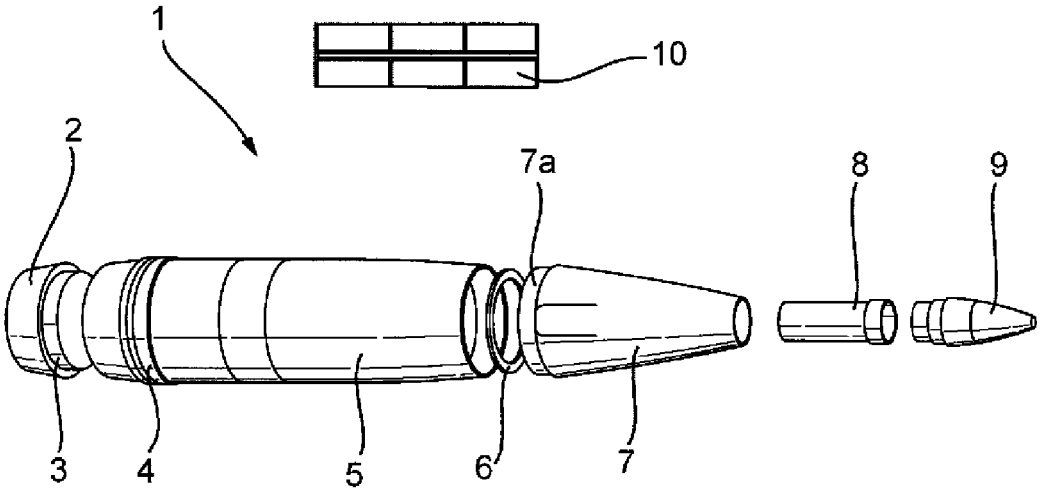
FIG. 1 show an exploded side view of a smoke screen shell according to the invention.

Turing to FIG. 1 there is provided a shell 1, with a main body 5, which is manufactured from a steel alloy. Located around the circumference of the main body 5 is a copper driving band 4, which allows engagement with the rifling on the bore of a barrel, so as to impart spin. A tail unit 2 is located at the aft of the main body 5. The tail unit 2 is made from aluminium and contains a male threaded portion 3, which engages with a reciprocal female threaded portion (not shown) located in the aft of the main body 5. The smoke payload apparatus 10 (shown external to the shell 1), when located in the payload cavity (not shown), inside the main body 5, is retained in place by use of a locking ring 6, which screws into the forward end of main body 5. The frangible ogive element 7 has a frangible link 7*a*, in the form of an aluminium thread. The frangible ogive element 7 may be secured to the locking ring 6 or directly to the main body 5. The frangible ogive element 7 receives the expulsion charge 8 and fuze 9. Upon operation of the fuze 9, the expulsion charge 8 builds up pressure within the frangible ogive element and at the bursting pressure the thread 3 shears and the smoke payload apparatus 10 is expelled from the aft of the main body 5. During a blind event, the shell 1 would not function as detailed above, and would hit the ground, wherein the frangible link 7*a* would be caused to fail, such that if fuze 9 did erroneously function, that the expulsion charge 8 would be at least partially vented and would not cause the smoke payload apparatus 10 to be expelled from the shell 1.

Figure 2:
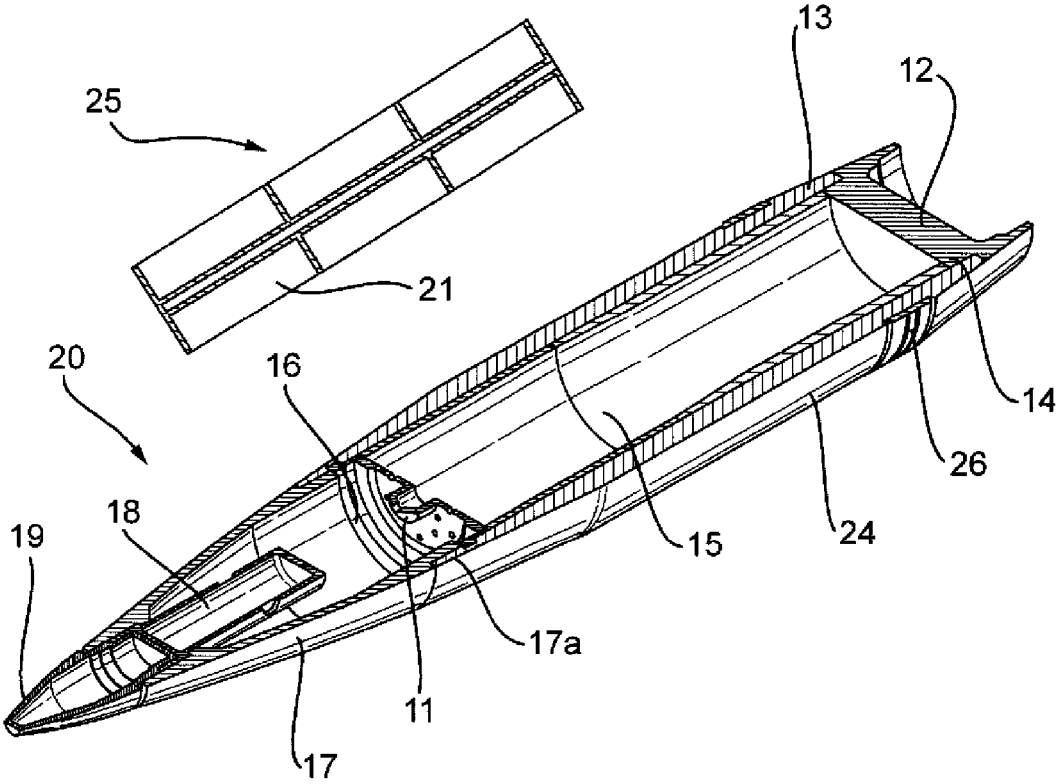
FIG. 2 shows a cross section along the axis of the shell in FIG. 1.

FIG. 2 shows a smoke shell 20, with a main body 24 formed from a steel alloy, with a driving band 26 located thereupon. A tail unit 12 is located at the aft of the main body 24. The tail unit 12 is made from aluminium and contains a male threaded portion 13, which engages with a reciprocal female threaded portion 14 located at the aft of the main body 24.

The smoke payload apparatus 25 is located in the payload cavity 15, and is retained in place by use of a locking ring 16, which screws into the forward end of main body 24.

The frangible ogive element 17 has a frangible link 17*a*, in the form of an aluminium thread, which is fastened to the locking ring 16. The frangible ogive element 17 receives the expulsion charge 18 and fuze 19. Upon operation of the fuze 19, the expulsion charge 18 builds up pressure within the frangible ogive element 17 and at the bursting pressure the thread 13 shears and the smoke payload apparatus 25 is expelled from the aft of the main body 24.

The smoke payload apparatus 25 is a modular smoke unit, which slides into the payload cavity 15.

Upon operation of the fuze 19, the expulsion charge 18 builds up pressure within the frangible ogive element 17 and at the bursting pressure the thread 13 on the tail unit shears and the smoke payload apparatus 25 is expelled from the aft of the main body 24. The expulsion charge may cause a delay composition 11 to ignite the smoke pellets 21.

During a blind event, the shell 20 would not function as detailed above, and would hit the ground, wherein the frangible link 17*a* would be caused to fail, such that if fuze 19 did erroneously function, that the expulsion charge 18 would be at least partially vented and would not cause the smoke payload apparatus 25 to be expelled from the shell 20.

FIG. 3*a* shows a smoke payload apparatus 30, which comprises a central support shaft 35, with threaded portion 38 which tethers to the tail unit (as shown in FIG. 4). The central support shaft 35 comprises vertical support splines 40 and horizontal support discs 36. The cavities formed between vertical support splines 40 and support discs 36 are filled with consolidated pellets of a smoke composition 31. The pellets 31 are unconfined and are thus capable of sustaining a burning front on all of their outer surfaces, when ignited. The pellets 31 are supported by the support discs 36, and are individually separated from each other by low friction paper 32, to prevent undesirable intimate contact and prevent frictional movement between adjacent pellets. A gas absorbent foamed polymer 34 is located between the pellets and the lower most disc within each cavity, such that upon gun launch the pellets move rearwardly towards the end 41 of the smoke payload apparatus, and hence move towards the support discs 36, the force exerted on the pellets 31 is reduced by action on the foam polymer 34. The foam polymer 34 is also capable of absorbing any undesirable gaseous products that evolve from the red phosphorous composition during long term storage, such as phosphine gas.

The expulsion charge (as shown in FIG. 2), will cause ejection of the apparatus 30 from the shell (FIG. 4), and said expulsion charge will also cause the ignition of the pellets 31. The flame front from the expulsion charge passes in the gap 39 between the pellet 31 and the intersection of two vertical support splines 40, (exemplified in FIG. 3*b*) and additionally passes through slots 37 in the support discs 36, such that all of the pellets 31 are ignited by the action of the expulsion charge, at substantially the same time. The pellets 31 are not tethered to the smoke payload apparatus 31, therefore once the apparatus has been ejected, and coupled with any imparted spin on the shell the pellets are thrown and dispersed over a desired target area.

FIG. 4 shows a cross section through a shell 51. The fuse 59 has been activated and has caused the expulsion charge 58 to function, the flame front causes a build up of pressure in the payload cavity 60, which causes shearing of the thread on the tail unit 52, and movement of the apparatus 55 rearwardly, to eject the apparatus from the aft end of the shell 51. The flame front 56 flashes down the channels between the pellets and apparatus and ignites the pellets 54, concomitantly with the ejection of the apparatus 55 from the munition 51. The central support shaft 57 is tethered 53 to the tail unit, by means of a screw thread, such that as the tail unit 52 is ejected the apparatus 55 exits on the same trajectory path.

The invention claimed is:

1. A smoke screening munition comprising a shearable tail unit, a main body which comprises a payload cavity for receiving a smoke payload apparatus, a shearable thread between the tail unit and the main body, a fuze, an ogive element located between said main body and the fuze, and an explosive train operably connected to said fuze, wherein the smoke payload apparatus comprises a plurality of portions of a smoke generating energetic material, wherein after delivery of the munition, said portions are configured to disperse in an unconfined manner and burn on at least two of their surfaces, wherein the smoke payload apparatus comprises a support shaft, with at least two vertical supports and at least two horizontal supports to each accommodate said portions of the smoke generating energetic material, and wherein each of the portions of the smoke generating energetic material abut the at least two vertical supports, and provide a flash though-hole between said portions and the support shaft, and wherein the at least two vertical supports are fixed to the support shaft or form an integral part of the support shaft.

2. The munition according to claim 1, wherein after the delivery of the munition, the portions burn on all of their surfaces.

3. The munition according to claim 1, wherein the smoke payload apparatus is tethered to the shearable tail unit.

4. The munition according to claim 1, wherein the main body comprises a first threaded portion manufactured from a first material, and the tail unit comprises a second threaded portion manufactured from a second material, wherein the second material has a lower hardness value than the first material.

5. The munition according to claim 4, wherein the first material is selected from a steel alloy and the second material is selected from aluminium or alloy thereof.

6. The munition according to claim 1, wherein the at least two vertical supports extend outwardly from the support shaft.

7. The munition according to claim 6, wherein at least one vertical support is positioned between a first portion and a second portion of the smoke generating energetic material.

8. The munition according to claim 6, wherein the portions of the smoke generating energetic material are consolidated pellets.

9. The munition according to claim 8, wherein said vertical and horizontal supports separate the pellets into stacks each comprising a plurality of said consolidated pellets.

10. The munition according to claim 9, wherein said consolidated pellets in each of the stacks are separated from each other with a barrier.

11. The munition according to claim 1, wherein the ogive element is a frangible ogive element.

12. The munition according to claim 11, further comprising a locking ring located between the main body and said frangible ogive element, to retain said smoke payload apparatus within the payload cavity, wherein the payload cavity has substantially parallel walls, which extend from the tail unit to the locking ring.

13. The munition according to claim 1, wherein the smoke payload apparatus is capable of being dispensed rearwardly from the main body upon shearing the shearable thread.

14. A method of dispensing a smoke payload apparatus from a munition according to claim 1, wherein the explosive train is operatively coupled to an expulsion charge, and said smoke payload apparatus is tethered to the shearable tail unit, the method comprising causing initiation of the expulsion charge, which causes ignition of said portions of the smoke generating energetic material and shearing of the shearable thread, such that said smoke payload apparatus is caused to be pushed rearwardly from said main body, to disperse said portions of the smoke generating energetic material.

15. The munition according to claim 1, further comprising a locking ring located between the main body and said ogive element, to retain said smoke payload apparatus within the payload cavity and prevent movement, wherein the payload cavity has substantially parallel walls, which extend from the tail unit to the locking ring.

16. A smoke screening munition comprising:

a shearable tail unit;

a main body which comprises a payload cavity for receiving a smoke payload apparatus, wherein the smoke payload apparatus is tethered to the shearable tail unit, and wherein the smoke payload apparatus comprises a plurality of portions of a smoke generating energetic material, wherein after delivery of the munition, said portions are configured to disperse in an unconfined manner, each of the portions being configured to burn on at least two of its surfaces;

a shearable thread between the tail unit and the main body;

a fuze operatively coupled to an expulsion charge; and an ogive element located between said main body and the fuze, a support shaft, with at least two vertical supports and at least two horizontal supports to each accommodate said portions of the smoke generating energetic material, and wherein each of the portions of the smoke generating energetic material abut the at least two vertical supports, and provide a flash though-hole between said portions and the support shaft, and wherein the at least two vertical supports are fixed to the support shaft or form an integral part of the support shaft;

wherein the smoke payload apparatus is capable of being dispensed rearwardly from the main body upon shearing of the shearable thread in response to the expulsion charge being stimulated.

17. The munition according to claim 16, wherein the smoke payload apparatus comprises a support shaft, with at least one vertical support and at least one horizontal support to accommodate said portions of the smoke generating energetic material, and wherein the portions of the smoke generating energetic material are consolidated pellets.

18. The munition according to claim 16, further comprising a locking ring located between the main body and said ogive element, to retain said smoke payload apparatus within the payload cavity.

19. The munition according to claim 16, wherein the ogive element is a frangible ogive element.

20. The munition according to claim 19, further comprising a locking ring located between the main body and said ogive element, to retain said smoke payload apparatus within the payload cavity and prevent movement, wherein the payload cavity has substantially parallel walls, which extend from the tail unit to the locking ring.

* * * * *